US005215235A

United States Patent [19]

Maekawa et al.

[11] Patent Number: 5,215,235

[45] Date of Patent: Jun. 1, 1993

[54] WATCH BAND

[75] Inventors: Yasuo Maekawa; Takashi Masuda; Tomomi Murakami; Masahiko Waki; Takayuki Takahashi, all of Tanashi, Japan

[73] Assignee: Citizen Watch Co., Ltd., Tokyo, Japan

[21] Appl. No.: 865,765

[22] PCT Filed: Feb. 14, 1989

[86] PCT No.: PCT/JP89/00147

§ 371 Date: Aug. 15, 1990

§ 102(e) Date: Aug. 15, 1990

[87] PCT Pub. No.: WO89/07406

PCT Pub. Date: Aug. 24, 1989

Related U.S. Application Data

[63] Continuation of Ser. No. 555,491, Aug. 15, 1990, abandoned.

[30] Foreign Application Priority Data

| | | | |
|---|---|---|---|
| Feb. 16, 1988 | [JP] | Japan | 63-33548 |
| Oct. 18, 1988 | [JP] | Japan | 63-262311 |
| Nov. 15, 1988 | [JP] | Japan | 63-286781 |

[51] Int. Cl.[5] ..... A44C 5/18; A44C 5/14

[52] U.S. Cl. ..... 224/176; 224/164; 224/177; 368/282; 24/265 WS

[58] Field of Search ..... 224/175, 176, 177, 164, 224/168, 169; 368/281, 282; 24/265 B, 265 WS

[56] References Cited

U.S. PATENT DOCUMENTS

| | | | |
|---|---|---|---|
| 1,191,951 | 7/1916 | DePollier | 224/176 |
| 1,497,341 | 6/1924 | Meyer | 224/176 |

FOREIGN PATENT DOCUMENTS

| | | | |
|---|---|---|---|
| 2278286 | 2/1976 | France | 224/164 |
| 447075 | 4/1949 | Italy | 224/164 |
| 481162 | 3/1953 | Italy | 224/176 |
| 505650 | 12/1954 | Italy | 224/176 |
| 58-121208 | 8/1983 | Japan . | |
| 59-85602 | 5/1984 | Japan . | |
| 78310 | 11/1918 | Switzerland | 224/176 |
| 82823 | 10/1919 | Switzerland | 224/176 |
| 135532 | 12/1929 | Switzerland | 368/282 |

*Primary Examiner*—Linda J. Sholl

[57] ABSTRACT

A watch band the effective length of which is elongated so that the watch can be worn on a ski glove is disclosed. An end of the band is folded back at a spring loaded pin attached to a case of a watch at one side thereof and connected to the pin. A middle portion of the band is folded back at a connecting link having a slit. The other end of the band is secured to an adjusting link and fixed to a middle portion of the band by a grasping portion provided on the adjusting link.

8 Claims, 8 Drawing Sheets

WATCH BAND

This application is a continuation, of application Ser. No. 07/555,491 filed on Aug. 15, 1990, now abandoned.

TECHNICAL FIELD

The present invention relates to a watch band, and more particularly to a watch band, the effective length of which can be elongated more than an ordinary length.

Generally, a band, the effective length of which is adjustable, is widely used. The adjustable length of the band is about 1.2 times as large as the length needed for the wrist of an ordinary person.

Usually, the watch is directly worn on the wrist of the user. When skiing, it is convenient for a skier if the watch can be worn on a ski glove, enabling him to know the time without folding back the edge of the glove and the sleeve of the ski wear. However, the ski glove is bulky so that the surrounding length of the glove at the wrist is more than 1.3 times as large as that of the wrist.

If longer than normal band is attached to the watch, it is possible to wear the watch on the ski glove. However, in ordinary use, it is hard to wear such a long band because there remains a long spare part of the band. Further, the watch is covered with a part of the band, causing difficulty in telling the time.

An object of the present invention is to provide a watch band the length of which can be elongated, thereby enabling to wear the watch over an extremely thick portion such as a ski glove and a sleeve of a coat.

Another object of the invention is to provide a watch band which is easily connected to and removed from the watch.

DISCLOSURE OF THE INVENTION

To this end, the present invention is characterized by a watch band comprising the band being flexible, fixing means for fixing an end of the band folded back at a spring loaded pin attached to a case of a watch at one side thereof, a connecting link having a slit through which the band is inserted and folded back, and connected to the watch case at the other side, an adjusting link secured to the other end of the band and having a grasping portion to be fixed to a middle portion of the band, the effective length of the band being adjusted at the slit of the connecting link and the end of the band being fixed to the middle portion by the grasping portion.

PREFERRED EMBODIMENT OF

Figure 1:
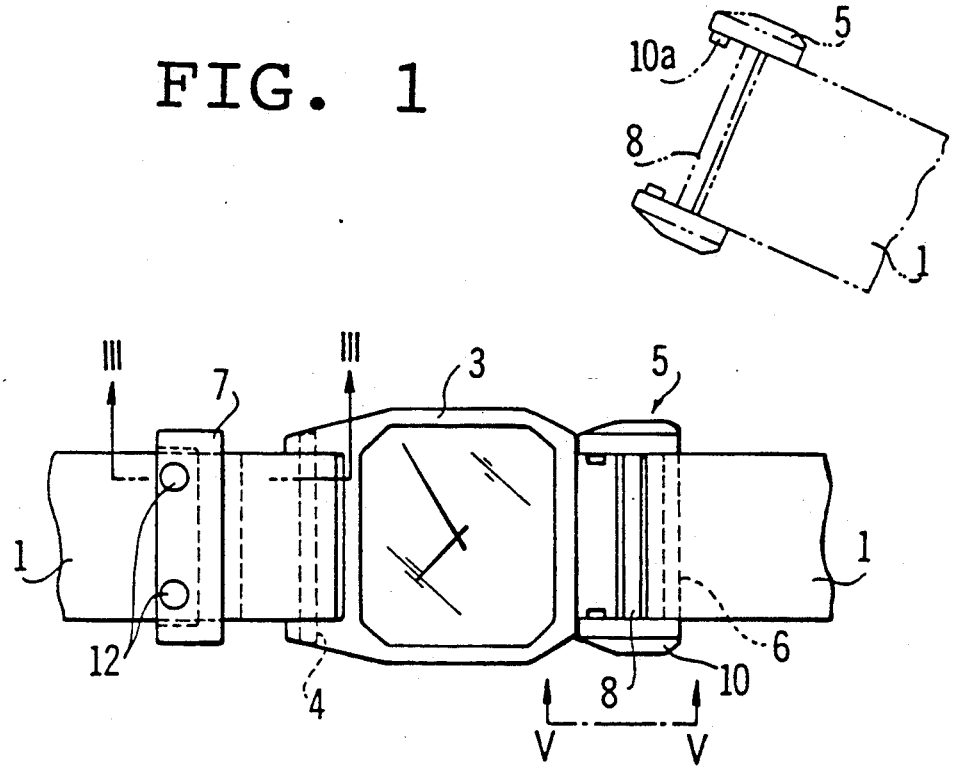
FIG. 1 is a plan view showing a watch band connected to a watch according to the present invention.
Figure 2:
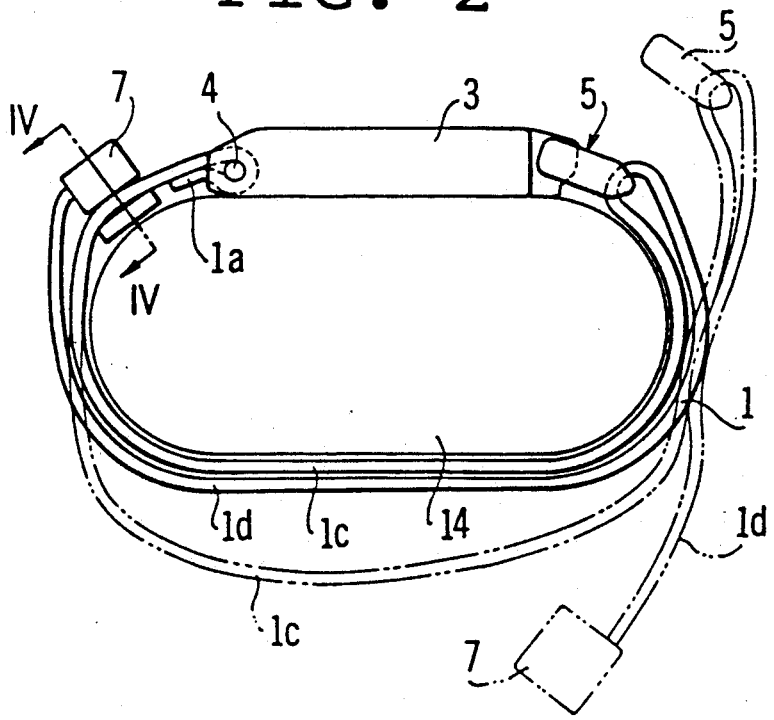
FIG. 2 is a side view showing the watch worn on a wrist of a user.
Figure 3:
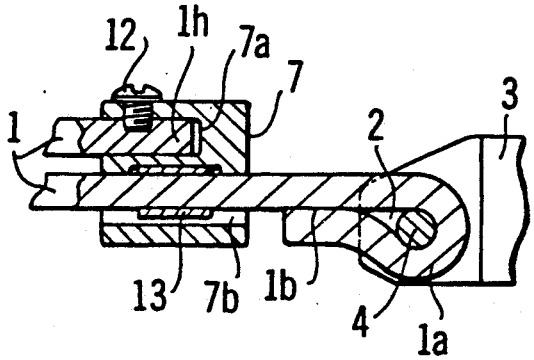
FIG. 3 is a sectional view of the watch band taken along a line III—III of FIG. 1.

Referring to FIGS. 1 and 2, a watch band 1 is made of synthetic fiber knitted to form a belt. Referring to FIG. 3, an end portion 1*a* of the band 1 is looped to form a hole 2 and adhered to the main part of the band at an end 1*b*. A spring loaded pin 4 mounted on an end of a watch case 3 is inserted into the hole 2 so that the end of the band 1 is connected to the watch case 3. As shown in FIG. 2, a middle portion in the length of the band 1 is folded back at a connecting pin 6 (FIG. 6) of a connecting link 5 and the other end of the band 1 is secured to an adjusting link 7 which is detachably attached to the band 1.

Each part of the band will be described hereinafter in detail.

Figure 5:
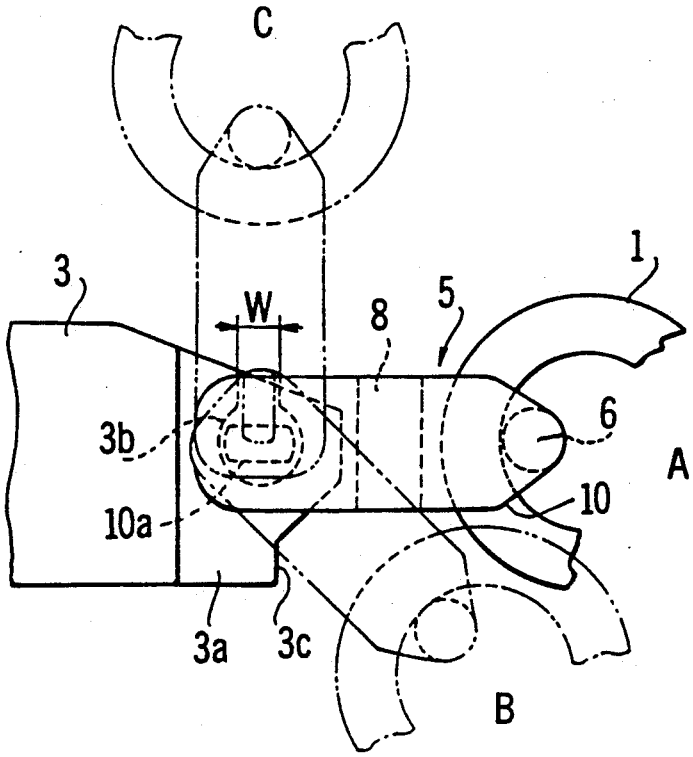
FIG. 5 is a side view of the watch as viewed from arrows V—V of FIG. 1.
Figure 6:
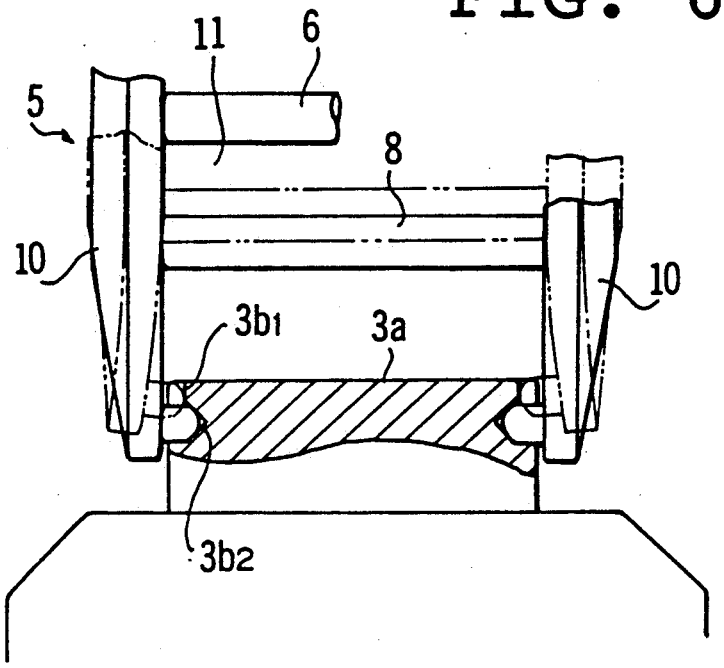
FIG. 6 is a plan view showing a part of a connecting link of the watch band, partly shown in section.
Figure 7:
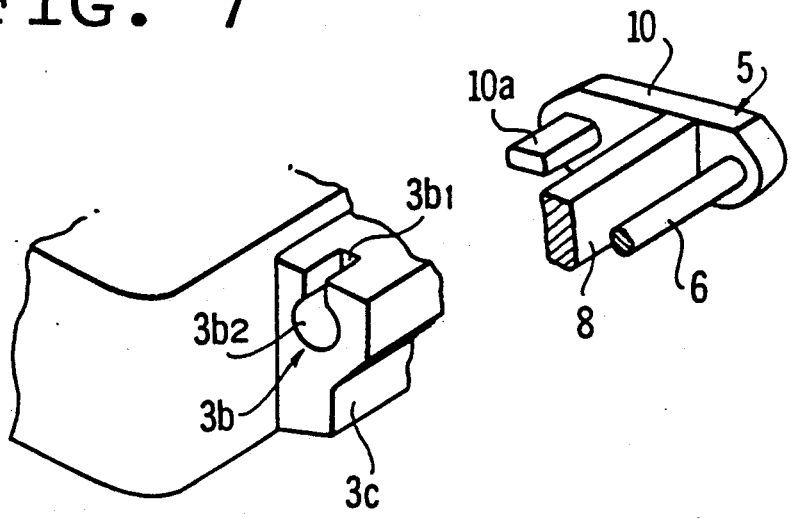
FIG. 7 is a perspective view partly showing the connecting link connected to a watch case.

Referring to FIGS. 6 and 7, the connecting link 5 made of plastics comprises a pair of side plates 10, and the connecting pin 6 and a lateral pin 8 which are integrated with the side plates 10. A slit 11 is formed between the pins 6 and 8 so as to put the band 1 through it. On an inner end of each side plate 10, an engaging lug 10*a* is provided to be inwardly projected from the side plates. The watch case 3 has a connecting projection 3*a* having opposite engaging grooves 3*b* formed on the outer end thereof corresponding to the engaging lugs 10*a* of the connecting link 5. As shown in FIGS. 5 and 7, the engaging lug 10*a* has an elliptic shape in section such that the length of the lug in the major axis direction is larger than the width W of the engaging groove 3*b* and the length in the minor axis direction is smaller than the width W.

As shown in FIG. 7, each engaging grooves 3*b* of the connecting projection 3*a* has a keyhole shape as viewed from the side, and hence has a shallow upper groove $3b_1$ and a deep circular groove $3b_2$.

Figure 4:
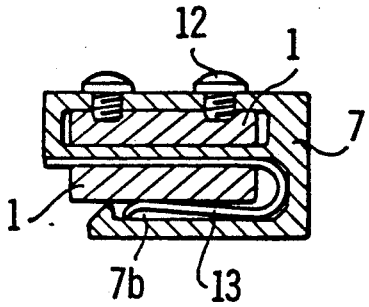
FIG. 4 is a sectional view of the watch band taken along a line IV—IV of FIG. 2.

Referring to FIGS. 3 and 4, the adjusting link 7 comprises a band receiving portion 7*a* for receiving the other end 1*h* of the band 1 and a clip portion 7*b* having a space to be engaged with the middle portion of the band 1. A pair of screws 12 are screwed in an upper plate of the link 7 to fix the end 1*h* of the band 1 to the receiving portion 7*a*. A U-shaped spring 13 is provided in the space of the clip portion 7*b* for grasping the band 1 so that the middle portion of the band 1 is fixed to the clip portion 7*b*.

The method of wearing the watch on the wrist will be described hereinafter.

The band 1 is put through the slit 11 of the connecting link 5. The end 1*h* of the band 1 is secured to the adjusting link 7 with screws 12. As shown by a chain line of FIG. 2, at first the adjusting link 7 is not fixed to the middle portion of the band 1, and hence a loop of the band 1 can be expanded. Thus, expanding the loop, the band 1 is put on wrist 14 and the watch is mounted on the wrist. The adjusting link 7 secured to the band 1 is pulled to surround the wrist 14 so that an inner band portion 1*c* is wound around the wrist 14. A residual outer band portion 1*d* is wound on the outside of the inner band portion 1*c*. The adjusting link 7 is slid on the band 1 in the lateral direction thereof and the clip portion 7*b* is engaged with the band 1 such as a tie pin. Thus, the watch is worn on the wrist, while the loop of the band is maintained.

At that time, the band 1 is grasped in the link 7 by the spring 13. In order to adjust the diameter of the loop formed by the band, the adjusting link 7 is removed from the band. The adjusting link 7 is engaged with the band 1 at a proper position on the band corresponding to the thickness of the wrist. Thus, the effective length of the band 1 can be easily adjusted.

From the foregoing, it will be understood that it is possible to elongate the effective length of the band to be wound on the wrist twice as large as the minimum effective length of the band.

Furthermore, the connecting link 5 is easily attached to or removed from the watch case, whereby the watch can be easily worn on or taken off the wrist while the determined loop of the band is maintained.

Attaching and detaching operations of the connecting link 5 will be described hereinafter with reference to FIGS. 5 and 6.

The engaging lugs 10*a* provided on the side plates of the connecting link 5 are engaged with the engaging grooves 3*b* of the watch case 3. Since the width W of the groove 3*b* is smaller than the width of the major axis of the lug 10*a*, when the connecting link 5 is at a position A of FIG. 5, the connecting link is prevented from removing from the watch case 3.

When the connecting link 5 is rotated in the clockwise direction and at a position B, the lateral pin 8 abuts on a wall 3*c* of the watch case 3 so that the rotation of the connecting link 5 is stopped. In an ordinary state, therefore, the connecting link can be freely rotated between the positions A and B.

Describing the removing operation of the connecting link 5 from the watch case 3, when the connecting link 5 is rotated in the counterclockwise direction and located at an upright position C as shown by dot-dash lines in FIG. 5, the minor axis of the engaging lug 10*a* corresponds to the upper groove $3b_1$ of the engaging groove 3*b*. Since the width of the engaging lug 10*a* is smaller than the width of the upper groove $3b_1$, the lug 10*a* is in the state to be easily removed from the engaging groove 3*b*. However, in order to prevent the engaging lugs 10*a* from easily removing from the engaging grooves 3*b* at the upright position C, the circular groove $3b_2$ has a lateral deep bottom as shown in FIG. 6 and the engaging lug 10*a* engages with the deep groove $3b_2$.

At the position C, the link 5 is forcibly pulled in the upward direction. Thus, the side plates 10 are slightly expanded in the opposite directions as shown by a chain line of FIG. 6, so that the watch case is separated from the connecting link 5. In order to connect the connecting link 5 to the case 3, the link 5 is located at a position corresponding the position C and forcibly pushed so that the engaging lugs 10*a* are inserted into the engaging grooves 3*b*. Then, the link is rotated in the clockwise direction of FIG. 5 to the position A.

Figure 8:
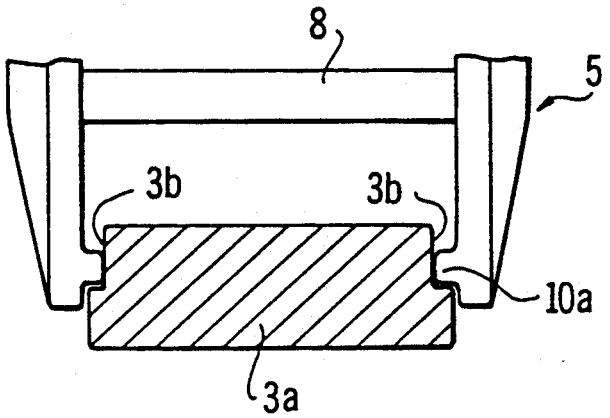
FIG. 8 is a sectional view showing an example of engaging grooves of the watch case.
Figure 9:
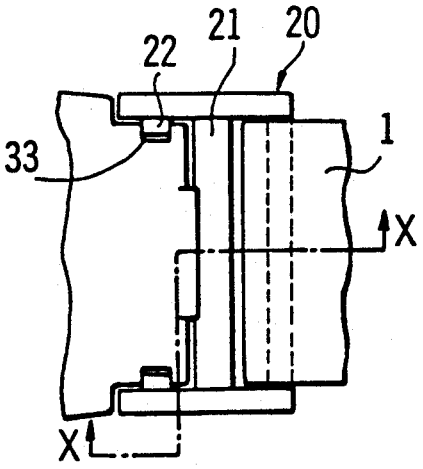
FIG. 9 is a plan view showing a connecting link of a second embodiment of the present invention.

FIG. 8 shows another example of the engaging grooves 3*b* in which each engaging groove 3*b* has a flat base.

Figure 10:
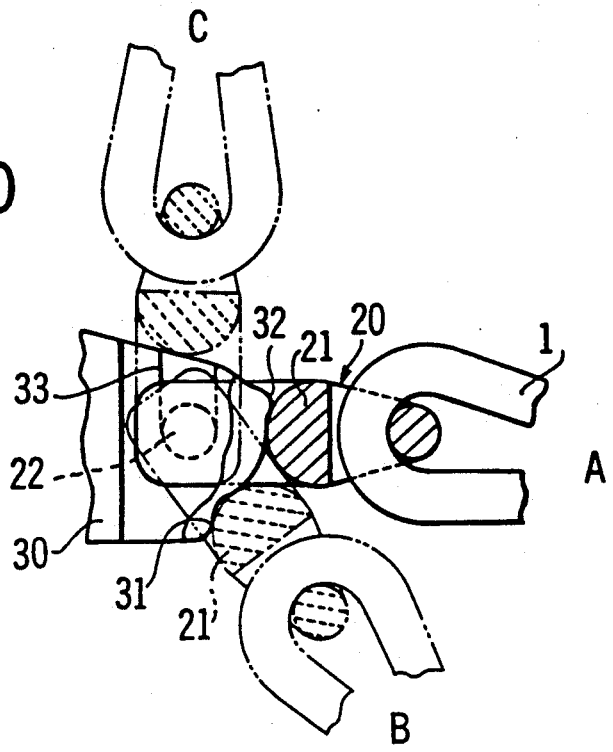
FIG. 10 is a sectional view showing a watch band of the second embodiment taken along a line X—X of FIG. 9.
Figure 11:
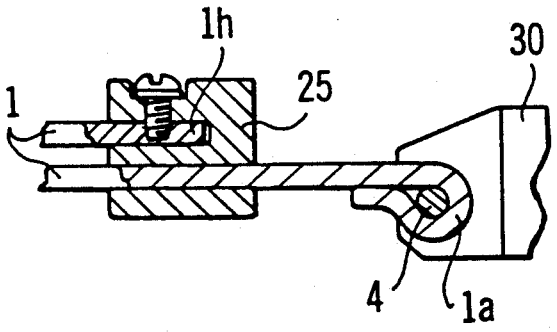
FIG. 11 is a sectional side view showing an adjusting link of the second embodiment.

FIGS. 9 to 12 show the second embodiment of the present invention. Referring to FIG. 10, a connecting link 20 has a lateral pin 21 having an arc portion formed in the front side of the pin corresponding to a watch case. Each engaging lug 22 has a circular shape in section. A watch case 30 has two projections 31 and 32 corresponding to the lateral pin 21. The projection 31 is formed to have a height such that the lateral pin 21 of the connecting link 20 can not be moved over the projection. The projection 32 has a height such that the lateral pin 21 can pass over the projection if the link 20 is forcibly rotated. In an ordinary state, the connecting link 20 can be freely rotated between the projections 31 and 32 about the engaging lugs 22. Each engaging groove 33 to be engaged with the engaging lug 22 has a flat base with the same width.

Figure 12:
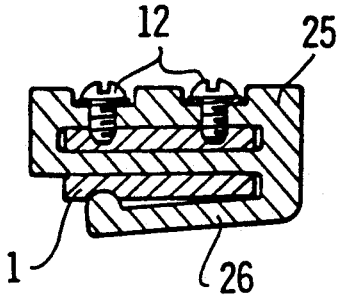
FIG. 12 is a sectional view of the adjusting link of FIG. 11.

Referring to FIG. 12, an adjusting link 25 has a grasping arm 26 formed on the underside portion thereof to have elasticity. Thus, the band 1 is grasped in the adjusting link 25 and secured thereto only by the grasping arm 26.

In order to remove the connecting link 20 from the watch case 30, when the connecting link 20 is forcibly rotated in the counterclockwise direction as shown in FIG. 10 by dot-dash lines, the lateral pin 21 reaches the upright position C passing over the projection 32. Then, the connecting link 20 is pulled in the upward direction, so that the connecting link is separated from the watch case. In order to connect the connecting link 20 to the case 30, an inverse operation is performed.

Figure 13:
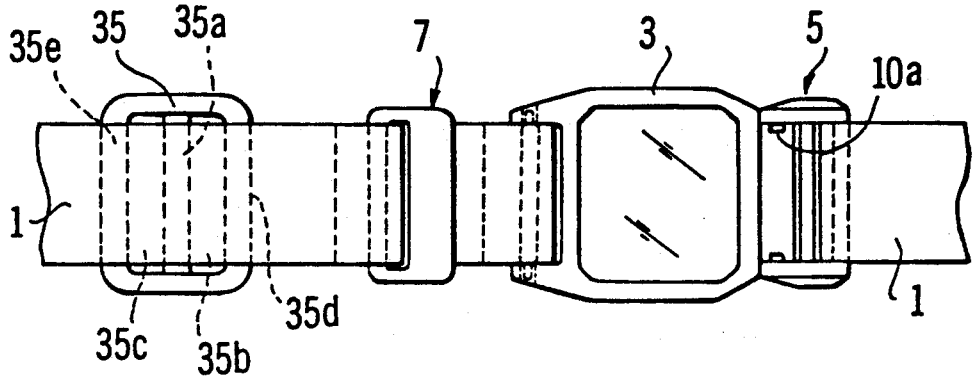
FIG. 13 is a plan view showing a third embodiment of the present invention.
Figure 14:
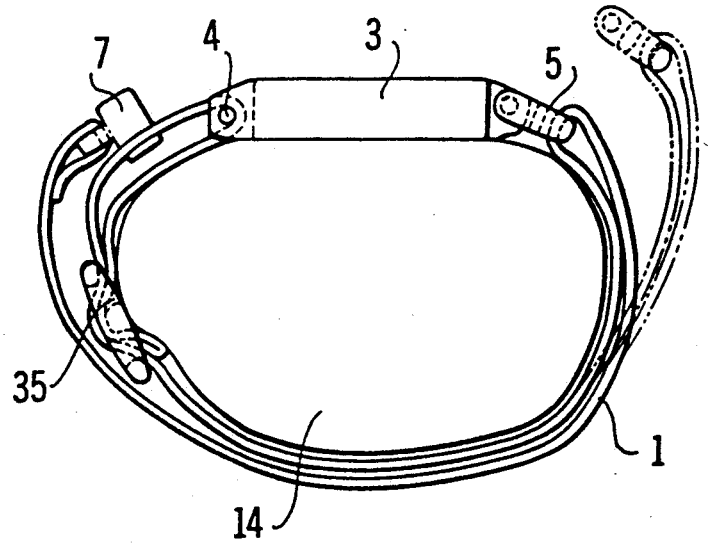
FIG. 14 is a side view of a watch band of the third embodiment.
Figure 15:
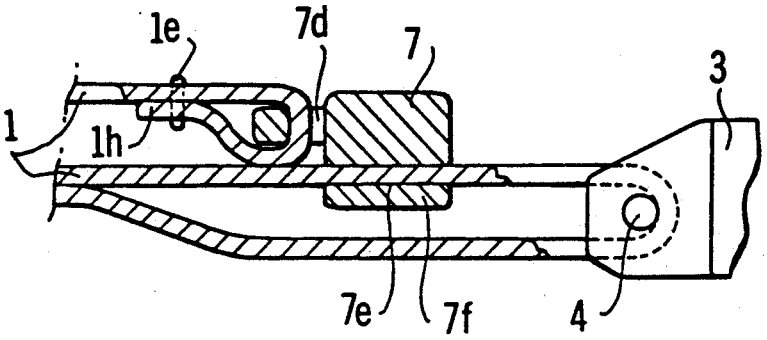
FIG. 15 is a sectional side view showing an adjusting link of the third embodiment.
Figure 16:
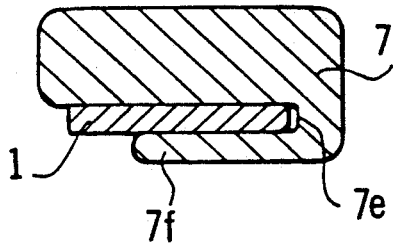
FIG. 16 is a sectional view of the adjusting link.
Figure 17:
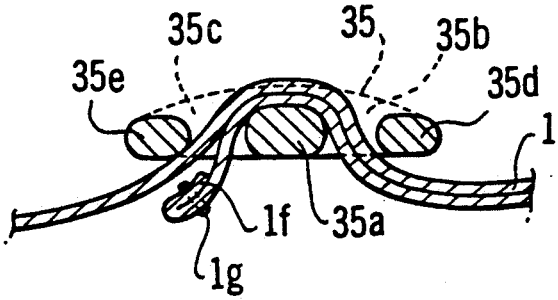
FIG. 17 is a sectional side view showing a buckle of the third embodiment.

Referring to FIGS. 13 to 17 showing the third embodiment, the same parts as the first embodiment are identified with the same reference numerals as FIGS. 1 to 7. Referring to FIG. 15, the band 1 is put through a slit 7*d* of the adjusting link 7 and folded back to double the band. The double band portion is sewed together with a thread 1*e*. The main part of the band is put through slits 35*c* and 35*b* of a buckle 35. As shown in FIGS. 14 and 17, the band 1 is folded back at the spring loaded pin 4 of the watch case 3 and put through the slits 35*b* and 35*c* of the buckle 35. An end 1*f* of the band is folded back by 5 mm to double the band which is sewed with a thread 1*g*. Referring to FIGS. 13 and 17, the buckle 35 comprises a cross bar 35*a* provided in the center thereof, and a pair of bridges 35*d* and 35*e* for forming the slits 35*b* and 35*c*. Each slit 35*b* and 35*c* is formed to have a lateral width which enables the double bands to put through it and disables triple bands to put through. Thus, the double end 1*f* can not pass the slit 35*c*. As shown in FIGS. 15 and 16, the band engaging portion of the adjusting link 7 comprises an engaging groove 7*e* engaged with a middle portion of the band, and a grasping arm 7*f*. The link 7 is made of plastic having elasticity so that the grasping arm 7*f* is adapted to firmly grasp the band 1 when engaged. Other structures and the attachment operation of the watch band of the third embodiment are the same as that of the first embodiment. Since the band of this embodiment is provided with a buckle, the length of the band can be elongated more than the previous embodiments. Furthermore, the diameter of the loop formed by the band is adjustable by sliding the buckle on the band.

Figure 18:
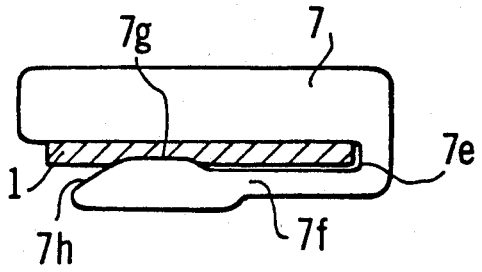
FIG. 18 is a plan view showing a modification of the adjusting link of the third embodiment.
Figure 19:
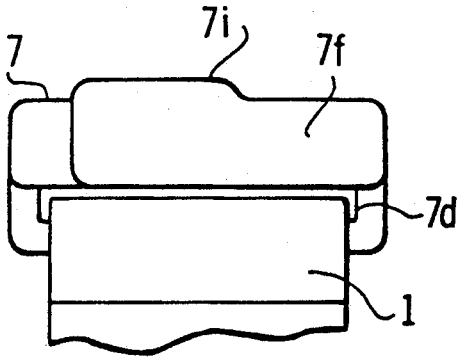
FIG. 19 is a rear view of the adjusting link of FIG. 18.

FIGS. 18 and 19 show a modification of the adjusting link of the third embodiment which is approximately the same in construction as the adjusting link 7 of FIG. 15. The grasping arm *7f* of the adjusting link 7 has an inner projection *7g* and a slant guide portion *7h* formed on the inside thereof. Consequently, the engaging groove *7e* is formed to have a narrow opening and a wide inner space so that a step portion is formed in the groove. When the adjusting link is engaged with the band 1, the elasticity of the grasping arm *7f* effectively acts on the band at the inner projection *7g*. Even if the band is laterally slid in the groove toward the outside of the link, the same grasping force of the projecting portion *7g* acts on the band so that the band is not removed from the link. Furthermore, since the slant guide portion *7h* is formed adjacent the inner projection *7g*, the band can be easily inserted in the engaging groove. In addition, a projecting portion *7i* is formed adjacent the inner projection *7g* on the grasping arm *7f* projected from the plate in the longitudinal direction of the band for easily engaging the adjusting link with the band. Namely, the lateral opposite sides of the link 7 are held with a thumb and a middle finger of the user and the projection *7i* is pushed up with a forefinger to open the groove for inserting the band thereto.

PROBABILITY OF INDUSTRIAL EXPLOITATION

In accordance with the present invention, the effective length of the band can be elongated to wear the watch on the ski glove. Furthermore, the length of the band is easily adjusted by engaging the adjusting link with the band to a proper position thereof.

We claim:

1. A watch band comprising:

a flexible band;

fixing means for fixing an end of the band folded back at a spring loaded pin attached to a case of a watch at one side thereof;

a connecting projection provided at the other side of the watch case, the connecting projection having opposite engaging grooves, each of which having an upper opening;

a connecting link, the connecting link having a slit through which the band is put and folded back, and a pair of engaging lugs, each of which is detachably engaged with one of the engaging grooves of the connecting projection of the watch case, the connecting link being arranged to be detached from the engaging groove by passing through the upper opening when the connecting link is located at a predetermined angular position with respect to the watch case; and an adjusting link, the adjusting link being attached to the other end of the band and having a grasping portion with a gap section to be engaged about a middle portion of the band;

the effective length of the band being adjusted at the slit of the connecting link and the end of the band being fixed to the middle portion by sliding the grasping portion on the band in the lateral direction of the band so that the gap section is engaged about the band.

2. The watch band according to claim 1 wherein the fixing means is a buckle for fixing the end of the band to the band.

3. The watch band according to claim 1 wherein the grasping portion of the adjusting link has a projection engaging the band.

4. The watch band according to claim 1 wherein the grasping portion of the adjusting link has a projection through which the adjusting link can be manipulated with a finger.

5. A watch and watch band combination comprising:

a watch, said watch including a watch case having a first and a second side, said first and second sides being disposed opposite to one another, a connecting projection provided at said first side, the connecting projection having opposite engaging grooves, each of which having an upper opening; and a flexible watch band, the band including fixing means for fixing an end of the band folded back at a spring loaded pin attached to said second side, a connecting link, the connecting link having a slit through which the band is put and folded back, and a pair of engaging lugs, each of which is detachably engaged with one of the engaging grooves, the connecting link being arranged to be detached from the engaging groove by passing through the upper opening when the connecting link is located at a predetermined angular position with respect to the watch case, and an adjusting link, the adjusting link being attached to the other end of the band and having a grasping portion with a gap section to be engaged about a middle portion of the band, the effective length of the band being adjusted at the slit of the connecting link and the end of the band being fixed to the middle portion by sliding the grasping portion on the band in the lateral direction of the band so that the gap section is engaged about the band.

6. The combination according to claim 5, wherein the fixing means is a buckle for fixing the end of the band to the band.

7. The combination according to claim 5, wherein the grasping portion of the adjusting link has a projection engaging the band.

8. The combination according to claim 5 wherein the grasping portion of the adjusting link has a projection through which the adjusting link can be manipulated with a finger.

* * * * *